US008459084B2

(12) United States Patent
Krajewski et al.

(10) Patent No.: US 8,459,084 B2
(45) Date of Patent: Jun. 11, 2013

(54) ELEVATED TEMPERATURE FORMING METHOD AND PREHEATER APPARATUS

(75) Inventors: Paul E. Krajewski, Troy, MI (US); Richard Harry Hammar, Shelby Township, MI (US); Jugraj Singh, Lake Orion, MI (US); Dennis Cedar, Rochester, MI (US); Peter A. Friedman, Ann Arbor, MI (US); Yingbing Luo, Ann Arbor, MI (US)

(73) Assignee: USAMP, Southfield, MI (US)

( * ) Notice: Subject to any disclaimer, the term of this patent is extended or adjusted under 35 U.S.C. 154(b) by 1110 days.

(21) Appl. No.: 12/366,310

(22) Filed: Feb. 5, 2009

(65) Prior Publication Data

US 2010/0192659 A1 Aug. 5, 2010

(51) Int. Cl.
*B21D 37/16* (2006.01)
*B21D 45/00* (2006.01)

(52) U.S. Cl.
USPC ..... 72/342.1; 72/342.94; 72/344; 72/405.03; 148/714

(58) Field of Classification Search
USPC ..... 72/342.1, 342.7, 342.94, 343, 344, 72/405.03, 405.1, 349, 463, 469, 364, 342.6, 72/342.5, 405.01; 148/714, 639, 640, 656; 198/952, 482.1, 483.1; 219/450.1
See application file for complete search history.

(56) References Cited

U.S. PATENT DOCUMENTS 4,079,232 A * 3/1978 Brokoff et al. ..... 219/154
4,902,215 A 2/1990 Seemann, III
5,620,715 A * 4/1997 Hart et al. ..... 425/143
5,900,311 A 5/1999 Campanella et al.
5,904,972 A 5/1999 Tunis, III et al.
6,159,414 A 12/2000 Tunis, III et al.
6,309,732 B1 10/2001 Lopez-Anido et al.
6,455,131 B2 9/2002 Lopez-Anido et al.
6,463,779 B1 10/2002 Terziakin
6,565,792 B2 5/2003 Hemphill
6,586,054 B2 7/2003 Walsh
6,732,558 B2 * 5/2004 Butscher et al. ..... 72/342.7
6,805,546 B2 10/2004 Hahn et al.
6,840,750 B2 1/2005 Thrash et al.
6,890,394 B2 * 5/2005 Carsley et al. ..... 148/564
7,137,201 B2 * 11/2006 Brodt et al. ..... 29/897.2
7,159,437 B2 1/2007 Schroth et al.
7,199,334 B2 4/2007 Friedman et al.
8,092,626 B2 * 1/2012 Nadella et al. ..... 264/45.1
2002/0069506 A1 * 6/2002 Brodt et al. ..... 29/505
2002/0167119 A1 11/2002 Hemphill
2002/0185785 A1 12/2002 Thrash et al.
2003/0075840 A1 4/2003 Hahn et al.

(Continued)

*Primary Examiner* — Dana Ross
*Assistant Examiner* — Pradeep C Battula
(74) *Attorney, Agent, or Firm* — Reising Ethington P.C.

(57) ABSTRACT

An elevated temperature forming system in which a sheet metal workpiece is provided in a first stage position of a multi-stage pre-heater, is heated to a first stage temperature lower than a desired pre-heat temperature, is moved to a final stage position where it is heated to a desired final stage temperature, is transferred to a forming press, and is formed by the forming press. The preheater includes upper and lower platens that transfer heat into workpieces disposed between the platens. A shim spaces the upper platen from the lower platen by a distance greater than a thickness of the workpieces to be heated by the platens and less than a distance at which the upper platen would require an undesirably high input of energy to effectively heat the workpiece without being pressed into contact with the workpiece.

10 Claims, 9 Drawing Sheets

U.S. PATENT DOCUMENTS

2004/0051214 A1 3/2004 Sheu et al.
2004/0135294 A1 7/2004 Thrash et al.
2005/0000957 A1* 1/2005 Jones et al. ..... 219/450.1
2006/0219334 A1* 10/2006 Brodt et al. ..... 148/647

* cited by examiner

ELEVATED TEMPERATURE FORMING METHOD AND PREHEATER APPARATUS

STATEMENT REGARDING FEDERALLY SPONSORED RESEARCH OR DEVELOPMENT

The U.S. government has a paid-up license in this invention and the right in limited circumstances to require the patent owner to license others on reasonable terms as provided for by the terms of Cooperative Agreement No. DE-FC26-02OR22910 awarded by the Department of Energy. This invention was made with government support under Cooperative Agreement No. DE-FC26-02OR22910 awarded by the Department of Energy. The government has certain rights in this invention.

CROSS-REFERENCES TO RELATED APPLICATIONS

Not Applicable.

BACKGROUND OF THE INVENTION

1. Field of the Invention

This invention relates generally to an elevated temperature forming method and preheater apparatus for fabrication of complex deep drawn panels such as door inners, lift gates, deck lids and hoods from sheet metal workpieces comprising a metal, such as aluminum or magnesium, having insufficient formability at lower temperatures.

2. Description of the Related Art Including Information Disclosed Under 37 CFR 1.97 and 1.98

Elevated temperature forming and the preheating of sheet metal workpieces is known in the art. For example, U.S. Pat. No. 6,463,779 issued 15 Oct. 2002 to Terziakin, discloses a preheating system that includes placing a sheet metal workpiece on a press table or lower die of a die set and rapidly preheating the workpiece to a desired temperature by running high-density electrical current through the workpiece. Current flow is then removed from the workpiece and an upper die of the die set is closed on the lower die, forming the workpiece into a desired shape. The workpiece may be left between the upper and lower dies of the die set under pressure long enough to cool the workpiece by conductive heat transfer into the upper and lower dies.

Also, U.S. Pat. No. 7,199,334 issued 3 Apr. 2007 to Friedman, et al., discloses a preheating system in which a sheet metal workpiece is placed on a lower platen of a convective heater assembly and sandwiched between an upper platen and the lower platen by actuating the heater assembly to lower the upper platen. The heater assembly then heats the workpiece to a desired temperature by conduction and the upper platen is raised to release the workpiece. The workpiece is then transferred to a forming press by actuating a shuttle assembly. The forming press is then actuated to form the workpiece.

In addition, GM's U.S. Pat. No. 6,890,394 issued 10 May 2005 to Carsley, et al. discloses a method for heating a cold worked sheet of superplastically formable metal composition by placing the sheet between two electrical resistance heated platens that are then closed together to within a critical gap distance of either side of the sheet. The critical gap distance is maintained by positioning shims between the platens before the platens are closed together.

However, an elevated temperature forming method and preheater apparatus constructed or executed according to these patents would be unable to support high volume fabrication of deep drawn panels from sheet metal workpiece of limited formability.

What would be desirable would be an elevated temperature forming system capable of high volume fabrication of deep drawn panels from sheet metal workpieces having insufficient formability at lower temperatures.

BRIEF SUMMARY OF THE DISCLOSURE

A method is provided for fabrication of deep drawn panels from sheet metal workpieces having insufficient formability at lower temperatures by providing a first sheet metal workpiece in a first stage position of a multi-stage pre-heater, heating the first workpiece to a first stage temperature lower than a desired pre-heat temperature, moving the first workpiece to a final stage position of the multi-stage preheater, heating the first workpiece to the desired final stage temperature, transferring the first workpiece to a forming press, and actuating the forming press to form the first workpiece.

Alternatively, the first workpiece may then be cooled and an operation may be performed on the first workpiece selected from the group of operations consisting of trimming, piercing, and flanging. Performing such operations after cooling improves dimensional accuracy of the first workpiece by causing the first workpiece to contract to a desired size and shape before any such operations are performed.

Alternatively, the steps of moving the first workpiece to a final stage position of the multi-stage preheater and heating the first workpiece to the desired final stage temperature include providing a second sheet metal workpiece in the first stage position of the multi-stage pre-heater, and heating the second workpiece in the first stage position to a first stage temperature.

Alternatively, the steps of moving the first workpiece to a final stage position of the multi-stage preheater and heating the first workpiece to the desired final stage temperature include moving the first workpiece to a second stage position of the multi-stage preheater after the step of heating the first workpiece to a first stage temperature, heating the first workpiece in the second position to a second stage temperature greater that the first stage temperature and less than a final stage temperature, moving the second workpiece to the second stage position after the step of heating the second workpiece to a first stage temperature, heating the second workpiece in the second stage position to a second stage temperature, providing a third sheet metal workpiece in the first stage position, and heating the third workpiece in the first stage position to a first stage temperature.

Alternatively, the step of transferring the first workpiece to a forming press includes transferring the first workpiece to a forming press as the second workpiece is moved to the final stage position.

Alternatively, the step of actuating the forming press to form the first workpiece includes actuating the forming press to form the first workpiece as a second workpiece is being heated in the final stage position to a final stage temperature.

Alternatively, the method may include the additional step of heating at least a portion of the press before the step of actuating the forming press to form the first workpiece.

Alternatively, the step of cooling the first workpiece includes blowing air over the workpiece.

In addition, a preheater apparatus is provided for preparing sheet metal workpieces for forming. The apparatus includes a lower platen having a generally planar upper surface and configured to transfer heat into a workpiece carried on the upper surface, and an upper platen disposed above the lower platen and having a generally planar lower surface disposed generally parallel to and spaced from the upper surface of the lower platen forming a gap between the platens. The upper platen is configured to transfer heat into a workpiece disposed between the upper platen and the lower platen. The preheater apparatus also includes a shim configured to space the lower surface of the upper platen from the upper surface of the lower platen by a distance greater than a thickness of a sheet metal workpiece to be heated by the platens and at least partially defining a blank path for receiving, passing, and removing workpieces from between the platens while maintaining a constant desired gap distance between the upper and lower platens. This arrangement allows a sheet metal workpiece to be received in the gap for heating and removed from the gap after heating, without first having to move the platens away from one another, and is thus better able to accommodate high volume throughput.

Alternatively, the shim has a thickness equal to a desired gap distance between the upper and lower platens and is positionable between the upper and lower platen to establish and maintain the desired gap distance for a given sheet metal workpiece thickness.

Alternatively, the preheater includes at least one additional shim, and each shim may have a thickness equal to a desired gap distance between the upper and lower platens, as well as respective inner facing surfaces positioned generally parallel to one another between the upper and lower platens at a distance from one another slightly greater than a width of sheet metal workpieces to be passed between them, defining for the workpieces a blank path.

Alternatively, the preheater includes at least one spacer having a thickness less than the desired gap distance and configured to be disposable between successive sheet metal workpieces as the workpieces are being pushed along the blank path. This spaces apart and prevents interference between adjacent workpieces.

Alternatively, the preheater includes at least one additional blank path extending generally parallel to the first blank path to increase throughput of workpieces.

Alternatively, the platens include at least two temperature zones arranged serially along the blank path and configured to raise workpieces to successively higher temperatures as the workpieces are moved along the blank path.

Alternatively, the platens include a single temperature zone configured to raise workpieces to successively higher temperatures to avoid having to move the workpieces to successive locations along the blank path.

Alternatively, the upper and lower platens are disc-shaped and may be supported for co-rotation on a common axis. The apparatus may include circumferentially-spaced workpiece receptacle positions between the platens, each such receptacle position configured to receive a workpiece at an input station, to heat the workpiece to a desired temperature, and to carry the workpiece, via platen rotation, to an output station.

Alternatively, the preheater includes an ejector adjacent each workpiece receptacle position configured to move a workpiece radially outward when the workpiece has been rotated to the output station to present the workpiece within reach of a transfer mechanism such as a robot to be engaged and moved to a forming station Alternatively, the preheater includes an end-effector configured to be carried by a transfer mechanism and to engage and retain a sheet metal workpiece for transport. The end-effector may also be configured to transfer heat to the metal workpiece to maintain a desired workpiece forming temperature during transport to a forming station.

Alternatively, the end-effector is configured to engage and retain the metal workpiece via suction to avoid damaging the workpiece and to provide more uniform heat transfer to the workpiece by contacting the workpiece over a larger heated surface area.

Alternatively, the end-effector includes a perforated metal panel having a back side configured to provide fluid communication between perforations of the panel and a vacuum source.

BRIEF DESCRIPTION OF THE SEVERAL VIEWS OF THE DRAWINGS

These and other features and advantages will become apparent to those skilled in the art in connection with the following detailed description and drawings of one or more embodiments of the invention, in which.

DETAILED DESCRIPTION OF THE INVENTION EMBODIMENT

Figure 1A:
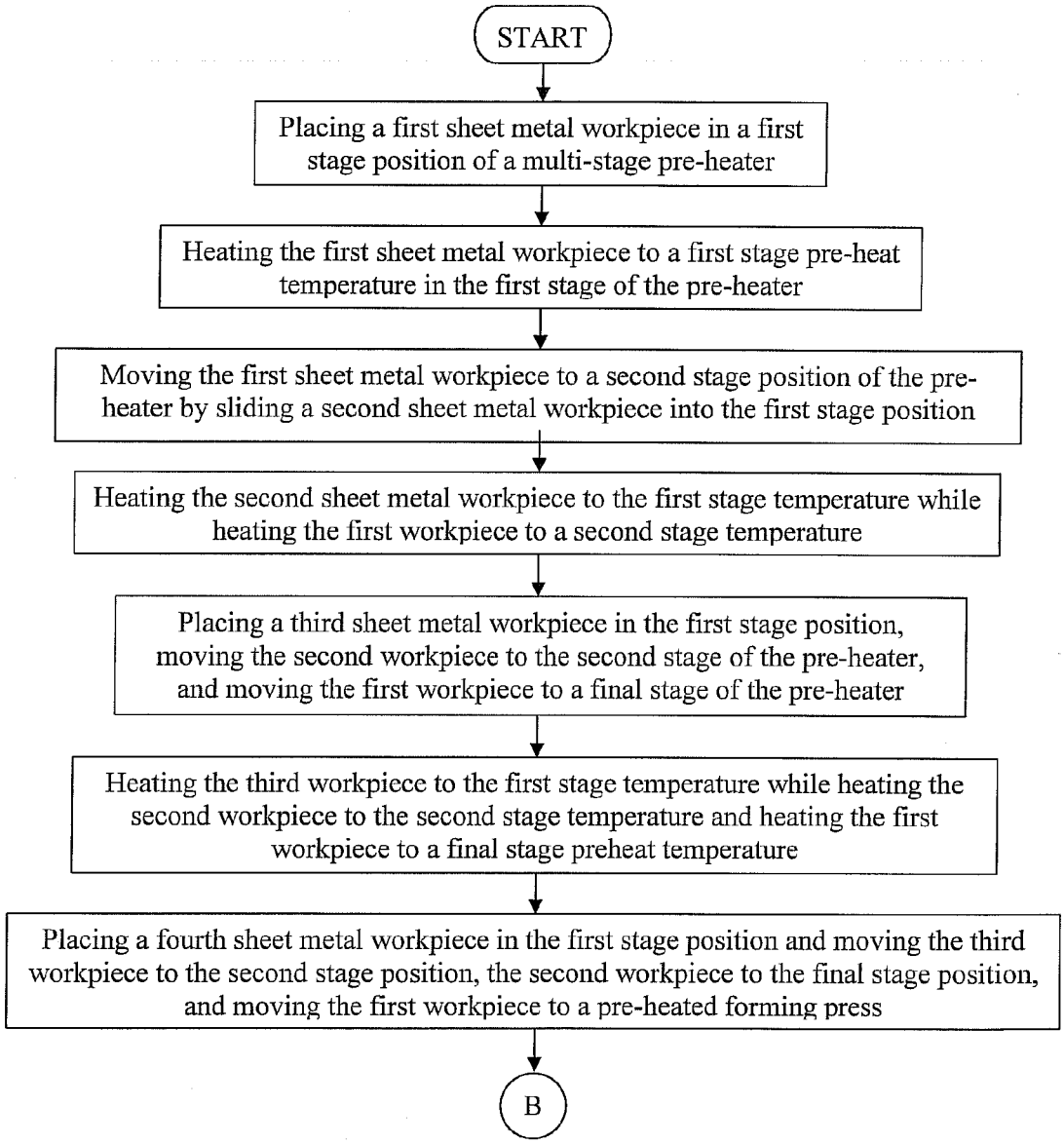
FIGS. 1*a* and 1*b* show is a flow chart showing a method for fabricating deep drawn panels from sheet metal workpieces according to the invention.
Figure 1B:
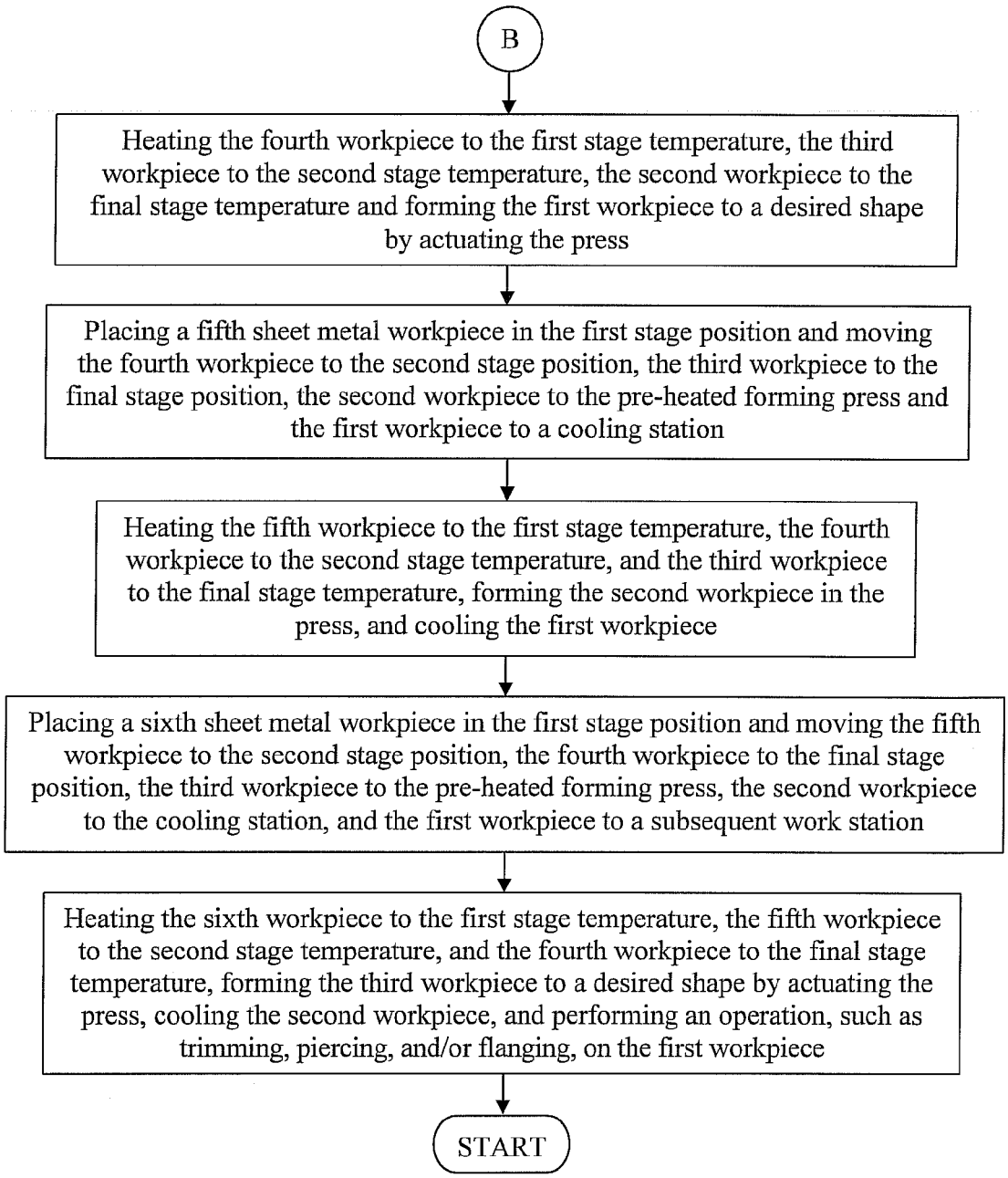
Figure 2:
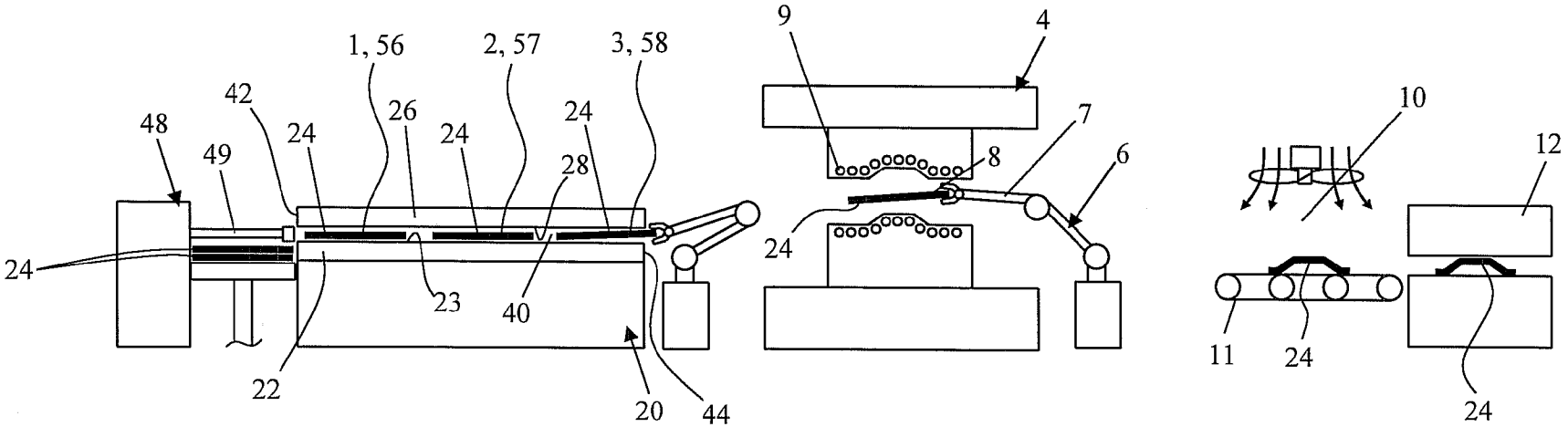
FIG. 2 is a schematic representation of sheet metal workpieces being processed according to an elevated temperature preheating and forming method executed according to the invention and additionally shows a preheater apparatus constructed according to the invention.
Figure 3:
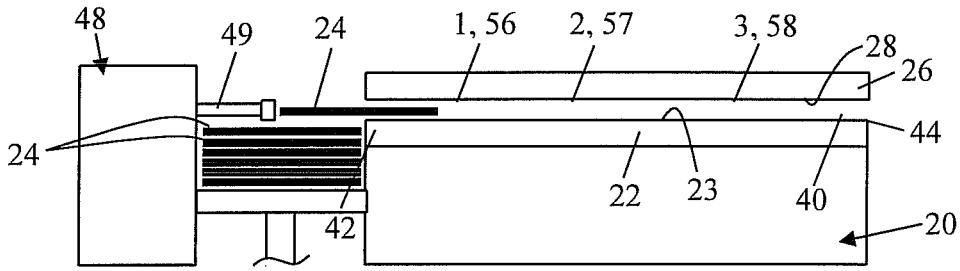
FIG. 3 is a schematic front view of the preheater apparatus of FIG. 2 shown downstream from a stack of sheet metal workpieces and a pusher positioned to move workpieces from the stack into the preheater.
Figure 4:
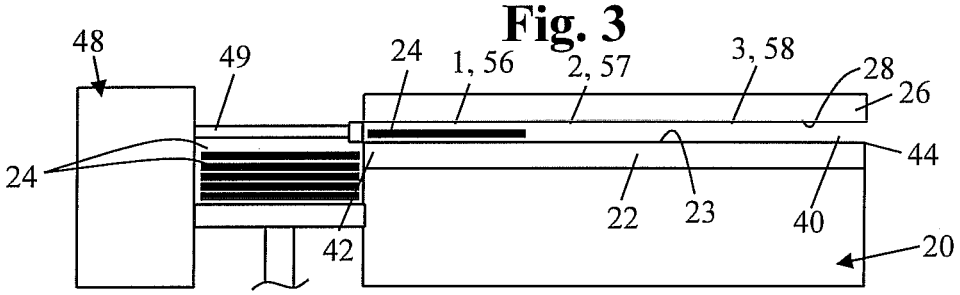
FIG. 4 is a schematic front view of the preheater apparatus, workpiece stack, and pusher of FIG. 3 showing the pusher pushing a first workpiece from the stack into a first temperature zone of the preheater.
Figure 5:
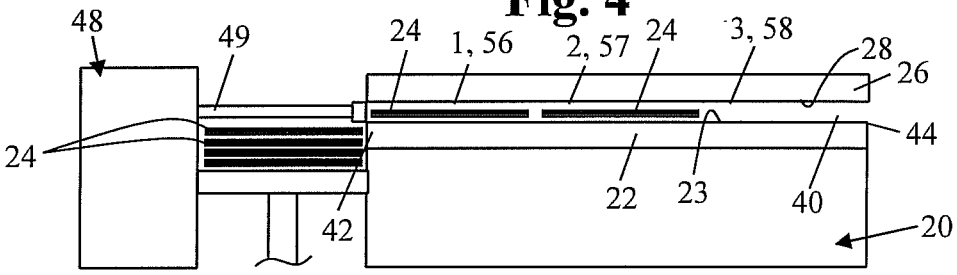
FIG. 5 is a schematic front view of the preheater apparatus, workpiece stack, and pusher of FIG. 3 showing the pusher pushing a second workpiece from the stack into the first temperature zone of the preheater and the first workpiece into a second temperature zone of the preheater.
Figure 6:
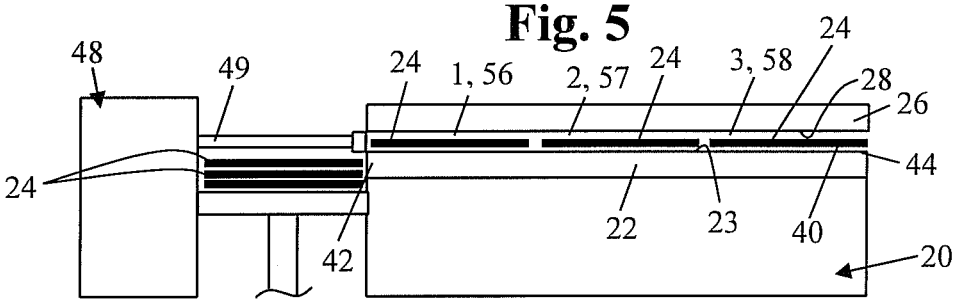
FIG. 6 is a schematic front view of the preheater apparatus, workpiece stack, and pusher of FIG. 3 showing the pusher pushing a third workpiece from the stack into the first temperature zone of the preheater, the second workpiece into the second temperature zone, and the first workpiece into a third temperature zone of the preheater.
Figure 7:
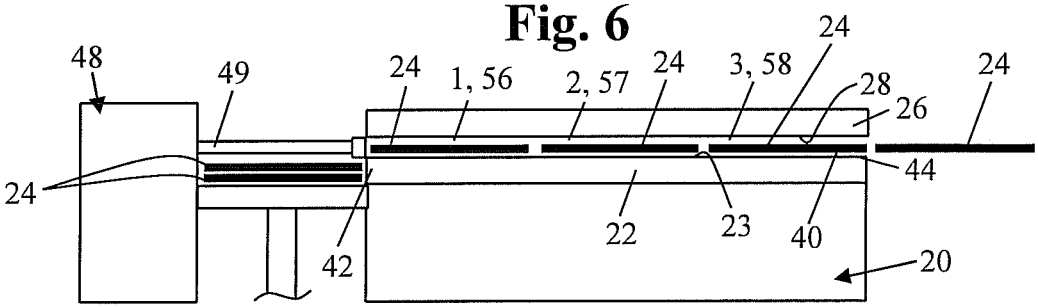
FIG. 7 is a schematic front view of the preheater apparatus, workpiece stack, and pusher of FIG. 3 showing the pusher pushing a fourth workpiece from the stack into the first temperature zone of the preheater, the third workpiece into the second temperature zone, the second workpiece into the third temperature zone, and the first workpiece out of the preheater.
Figure 8:
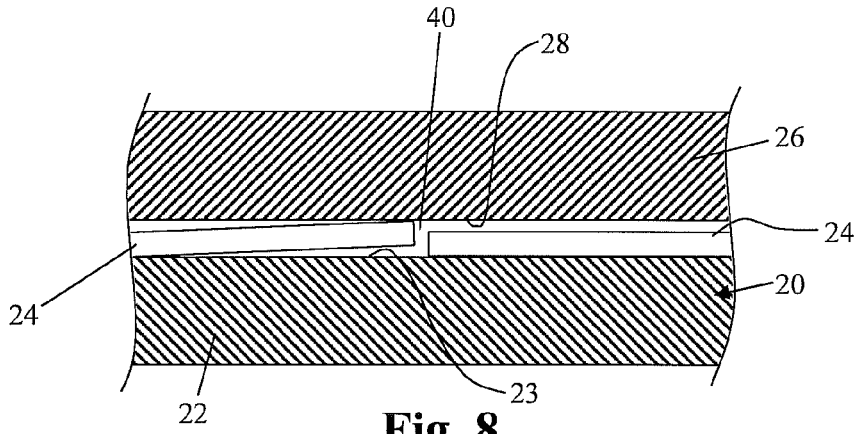
FIG. 8 is a schematic magnified partial cross-sectional view of the respective leading and trailing ends of two workpieces being pushed through the preheater.

As shown in the flowchart of FIGS. 1*a* and 1*b* and schematically in FIG. 2, a method is provided for the fabrication of complex deep drawn panels, such as door hinges, lift gates, deck lids and hoods, from sheet metal workpieces comprising materials, such as aluminum or magnesium, that have insufficient formability at lower temperatures. According to this method, a first prelubricated sheet metal workpiece 24 is provided in a first stage position 1 of a multi-stage preheater 20 and is heated to a first stage temperature lower than a desired preheat temperature. After the first workpiece 24 has been heated to the first stage temperature it may be moved to a second stage position 2 of the multi-stage preheater 20 and heated to a second stage temperature greater than the first stage temperature and less than a final stage temperature. After or as the first workpiece 24 is being moved from the first stage position 1 to the second stage position 2, a second prelubricated sheet metal workpiece 24 may be provided in the first stage position 1 of the multi-stage preheater 20 and heated to the first stage temperature while the first workpiece 24 is being heated to the second stage temperature in the second stage position 2. After the first workpiece 24 has been heated to the second stage temperature, and the second workpiece 24 has been heated to the first stage temperature, the first workpiece 24 may be moved to a final stage position 3 and the second workpiece 24 may be moved to the second stage position 2 and the first workpiece 24 heated to a final stage temperature in the final stage position 3 and the second workpiece 24 heated to the second stage temperature in the second stage position 2. After or as the first workpiece 24 is moved to the final stage position 3 and the second workpiece 24 is moved to the second stage position 2, a third workpiece 24 may be provided in the first stage position 1 and heated to the first stage temperature as the second workpiece 24 is being heated to the second stage temperature and the first workpiece 24 is being heated to the final stage temperature. After the first workpiece 24 has been heated to the final stage temperature in the final stage position 3 of the multi-stage preheater 20, the first workpiece 24 may be transferred to a forming press 4. As the first workpiece 24 is being transferred to the forming press 4 or after the first workpiece 24 has been transferred to the forming press 4, the second workpiece 24 may be moved to the final stage position 3 and the third workpiece 24 moved to a second stage position 2 and a fourth workpiece 24 provided in the first stage position 1. The first and successive workpieces 24 may be serially transferred to the forming press 4 by actuating a shuttle assembly or actuating a robot 6 having an arm 7 carrying an end effector 8 configured to engage and carry a workpiece 24. In other words, via a shuttle assembly, robot 6, or other suitable means, subsequent sheet metal workpieces 24 are transferred from the preheater 20 to the forming press 4 as the multi-stage preheater 20 continues to receive and provide staged heating to additional workpieces 24.

After each workpiece 24 has been transferred to the forming press 4, the forming press 4 is actuated to form the workpiece 24 into a desired shape. As one workpiece 24 is being formed by the forming press 4, a previous workpiece 24 may be in the process of being heated in the final stage position 3 of the preheater 20 to the final stage temperature, a next previous workpiece 24 may be in the process of being heated in the second stage position 2 to a second stage temperature in the preheater 20, and a next previous workpiece 24 may be in the process of being heated in the first stage position 1 of the preheater 20 to the first stage temperature. As the process continues, the forming press 4 may be periodically actuated to form subsequent workpieces 24 provided by the multi-stage preheater 20 at the final stage temperature.

Heaters 9 disposed within the press 4 may also be actuated either in advance of each press actuation step or for continuous energizing of heating elements during a serial heating and forming process involving many workpieces 24 so as to achieve and/or maintain a desired forming temperature in the workpieces 24 during forming. Any suitable means of heating appropriate portions of the forming press 4 may be used to include those disclosed in U.S. patent application Ser. No. 12/346,312, which was filed 30 Dec. 2008 and is incorporated herein by reference in its entirety.

After being formed by the forming press 4, each workpiece 24 may be removed from the forming press 4 and transferred to a cooling station 10 and/or to a conveyor 11 for transport to other work stations 12 while being cooled according to any one or more of a number of different well known cooling means known in the art to include the blowing of air over the workpieces 24. After having been cooled, additional operations may be performed on the workpieces 24 such as trimming, piercing, and flanging. These operations are preferably performed on the workpieces 24 after cooling the workpieces 24 so that dimensional accuracy of the workpieces 24 may be enhanced. Dimensional accuracy may be enhanced by allowing or causing the workpieces 24 to contract to a desired size and shape before such operations are performed.

A suitable preheater apparatus is generally shown at 20 in FIGS. 2-11. Second, third and fourth embodiments of the preheater apparatus are generally shown at $\mathbf{20}^2$, $\mathbf{20}^3$, and $\mathbf{20}^4$ in FIGS. 12, 13, and 14, respectively, and a fifth embodiment is generally shown at $\mathbf{20}^5$ in FIGS. 15-17. Reference numerals with the superscript 2, 3, and 4 designations in FIGS. 12, 13, and 14, respectively, and numerals with the superscript 5 in FIGS. 15-17, indicate alternative configurations of elements that also appear in the first embodiment. Unless indicated otherwise, where a portion of the following description uses a reference numeral to refer to FIGS. 2-17, that portion of the description applies equally to elements designated by reference numerals having the superscript 2, 3, and 4 designations in FIGS. 12, 13 and 14, respectively and the superscript 5 designation in FIGS. 15-17.

As shown in FIGS. 2-11, the preheater apparatus 20 may include a lower platen 22 having a generally planar upper surface 23 and may be configured to transfer heat into a workpiece 24 carried on the upper surface 23. The apparatus 20 may also include an upper platen 26 disposed above the lower platen 22 and having a generally planar lower surface 28 disposed generally parallel to and spaced from the upper surface 23 of the lower platen 22 forming a gap between the platens 22, 26. The upper platen 26 is configured to transfer heat into a workpiece 24 disposed between the upper platen 26 and the lower platen 22. The apparatus 20 may also include a shim 30 configured to space the lower surface 28 of the upper platen 26 from the upper surface 23 of the lower platen 22 by a distance greater than a thickness of a sheet metal workpiece 24 to be heated by the platens 22, 26 and at least partially defining a blank path 40 for receiving and passing workpieces 24 between the platens 22, 26. The shim 30 may be configured to space the lower surface 28 of the upper platen 26 from the upper surface 23 of the lower platen 22 by a distance less than that at which the upper platen 26 would require an undesirably high input of energy to effectively heat the workpiece 24 without being pressed into contact with the workpiece 24. This arrangement allows a sheet metal workpiece 24 to be received in the gap for heating without first having to move the platens 22, 26 away from one another. The sheet may have a thickness equal to a desired gasp distance between the upper and lower platens 22, 26 and may be positional between the upper and lower platens 22, 26 to establish and maintain the desired gap distance for a given sheet metal workpiece thickness.

Figure 9:
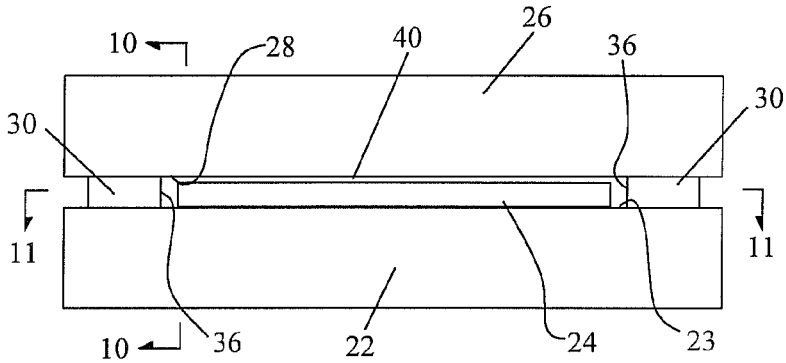
FIG. 9 is a schematic end view of a preheater constructed according to the invention and showing a workpiece positioned in a blank path between two shims.

As best shown in FIG. 9, the preheater apparatus 20 may include at least one additional shim 30, and each shim 30 may have an elongated rectangular prism shape and may each have a thickness equal to a desired gap distance between the upper and lower platens 22, 26. The shims 30 may have respective planar inner facing surfaces 36 positioned generally parallel to one another between the upper and lower platens 22, 26 at a distance from one another slightly greater than a width of this sheet metal workpieces 24 to be passed between them, defining for the workpieces 24 a blank path 40 extending generally from an input end 42 of the preheater 20 to an output end 44 of the preheater 20.

Figure 10:
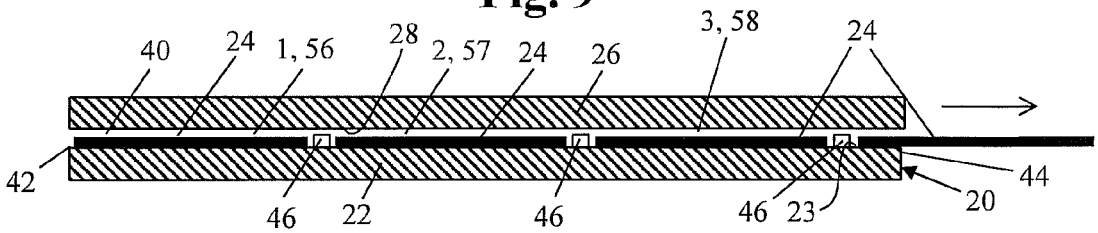
FIG. 10 is a schematic cross-sectional view of the preheater of FIG. 9 taken along line 10-10 of FIG. 9.
Figure 11:
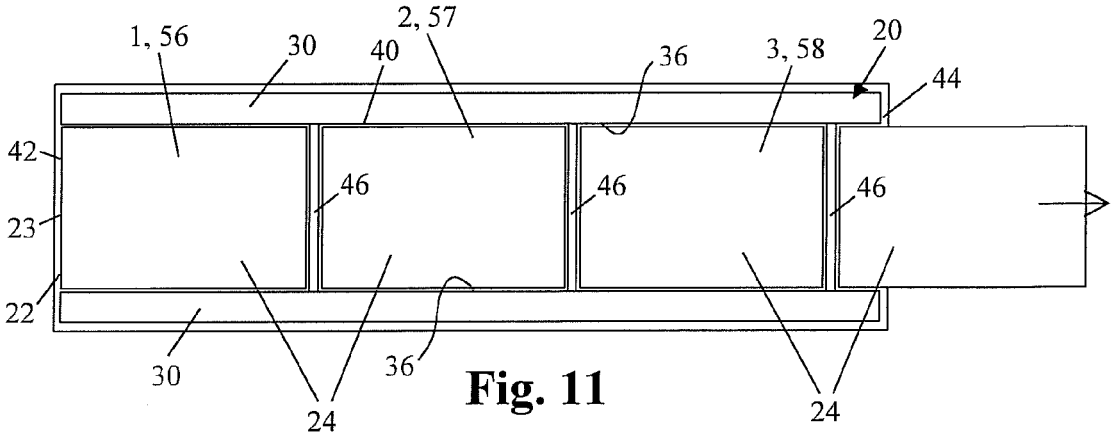
FIG. 11 is a schematic cross-sectional view of the preheater of FIG. 8 taken along line 11-11 of FIG. 9.

As shown in FIGS. 10 and 11 the preheater apparatus 20 may include at least one spacer 46, which may have an elongated rectangular prism shape, and may have a thickness slightly less than the desired gap distance. Each spacer 46 may be configured to be disposable between the respective trailing and leading edges of respective leading and trailing successive sheet metal workpieces 24 as the workpieces 24 are being pushed along the blank path 40. The spacers 46 serve to space apart and prevent interference and overlapping between adjacent workpieces 24. The use of spacers 46 may also allow platen gap distances to be set wider than twice the thickness of workpieces 24 in certain applications.

As shown in FIGS. 2-7, the preheater apparatus 20 may include a conveyor 48 configured to engage and propel successive sheet metal workpieces 24 along the blank path 40. The conveyor 48 may include an air cylinder driven pusher 49 arranged to push workpieces 24, one at a time, from a stack of workpieces 24 into the preheater 20 such that the successive pushing of workpieces 24 into the preheater 20 drives preceding workpieces 24 through the preheater 20 along the blank path 40.

Figure 12:
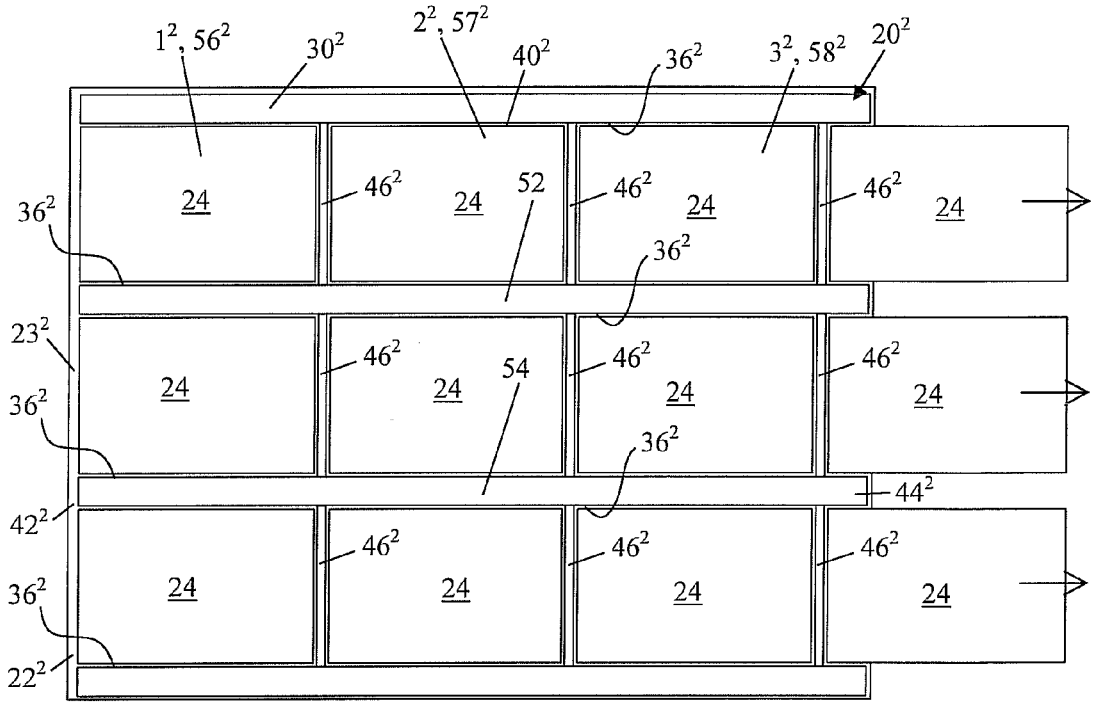
FIG. 12 is a schematic top view of workpieces being moved along three parallel blank paths through three heating zones on a lower platen of a preheater constructed according to an alternative embodiment of the invention.

As shown in the embodiment of FIG. 12, the preheater apparatus 202 may include two additional blank paths 52, 54 extending generally parallel to the first blank path 402 between the upper and lower platens 262 from the input end 422 to the output end 442 of the preheater 202. The use of additional blank paths 52, 54 increases throughput of workpieces 24.

Figure 18:
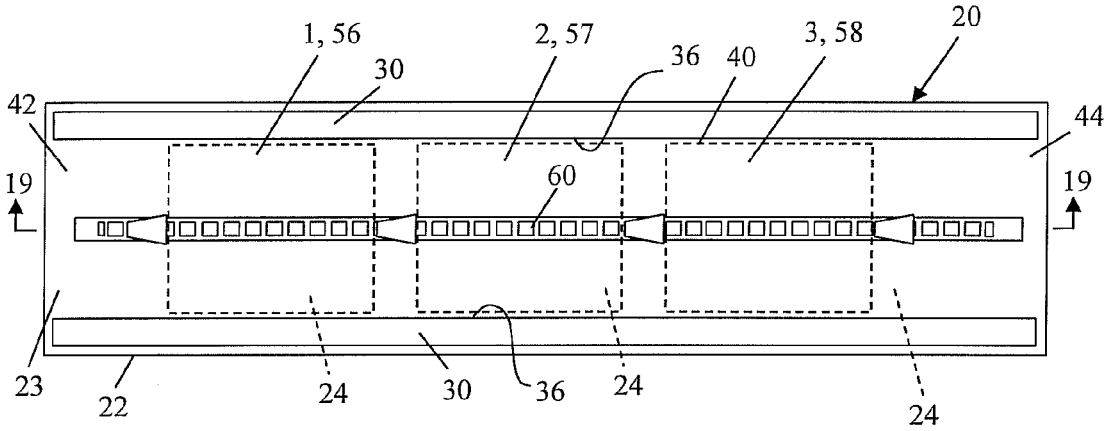
FIG. 18 is a schematic top view of workpieces being moved along a blank path on the lower platen of a preheater by a conveyor.
Figure 19:
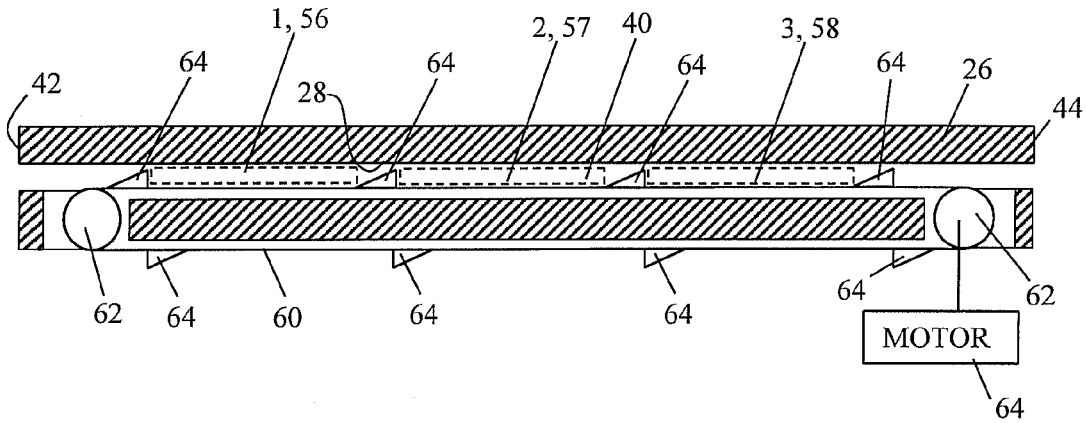
FIG. 19 is a schematic cross-sectional view of the preheater of FIG. 18 taken along line 19-19 of FIG. 18.

As shown in FIG. 11, the platens 22, 26 may include three temperature zones 56, 57, 58 arranged serially along the blank path 40 and configured to raise workpieces 24 to successively higher temperatures as the workpieces 24 are moved along the blank path 40. The three temperature zones 56, 57, 58 may all be set to the same temperature or may be set to different, e.g., successively higher, temperatures. The conveyor 48 may be configured to index sheet metal workpieces 24 along the blank path 40 such that each workpiece 24 dwells in each temperature zone a sufficient time to reach a desired temperature. As shown in FIGS. 18 and 19, the conveyor 48 may include a chain 60 supported on sprockets 62 and rollers. The chain 60 may include radially extending fingers 64 positioned to engage the trailing edges of workpieces 24 and to push the workpieces 24 along the blank path 40 as the chain 60 is driven around the sprockets 62 by an indexing motor 64.

Figure 13:
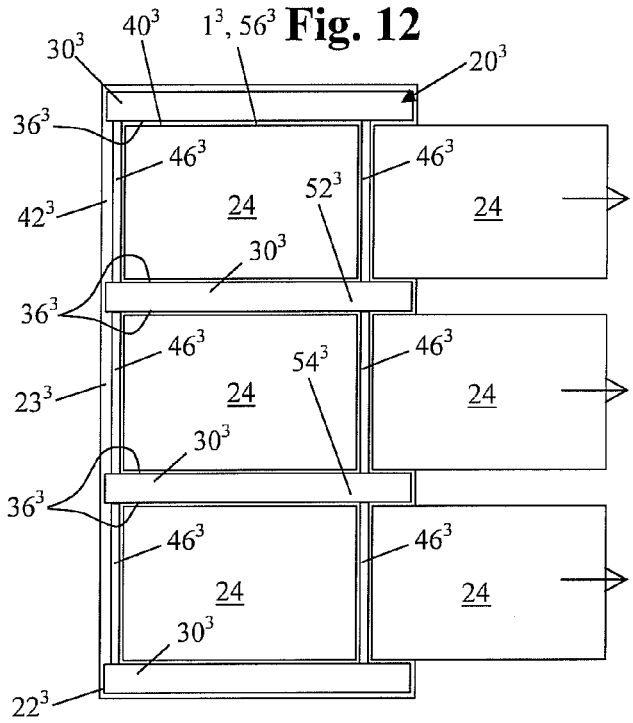
FIG. 13 is a schematic top view of workpieces being moved along three parallel blank paths through a single heating zone on a lower platen of a preheater constructed according to an alternative embodiment of the invention.

As shown in the embodiment of FIG. 13, the apparatus $\mathbf{20}^3$ may include platens $\mathbf{26}^3$ configured to provide only a single temperature zone $\mathbf{56}^3$ configured to raise workpieces 24 to successively higher temperatures while those workpieces 24 remain in respective single locations on their respective blank paths $\mathbf{40}^3$, $\mathbf{52}^3$, $\mathbf{54}^3$ and without moving the workpieces 24 to successive locations along their respective blank paths $\mathbf{40}^3$, $\mathbf{52}^3$, $\mathbf{54}^3$. This arrangement has the advantage of precluding or limiting the formation of scratches in the surfaces of the workpieces 24 as they approach through and slip along between successive temperature zones.

Figure 14:
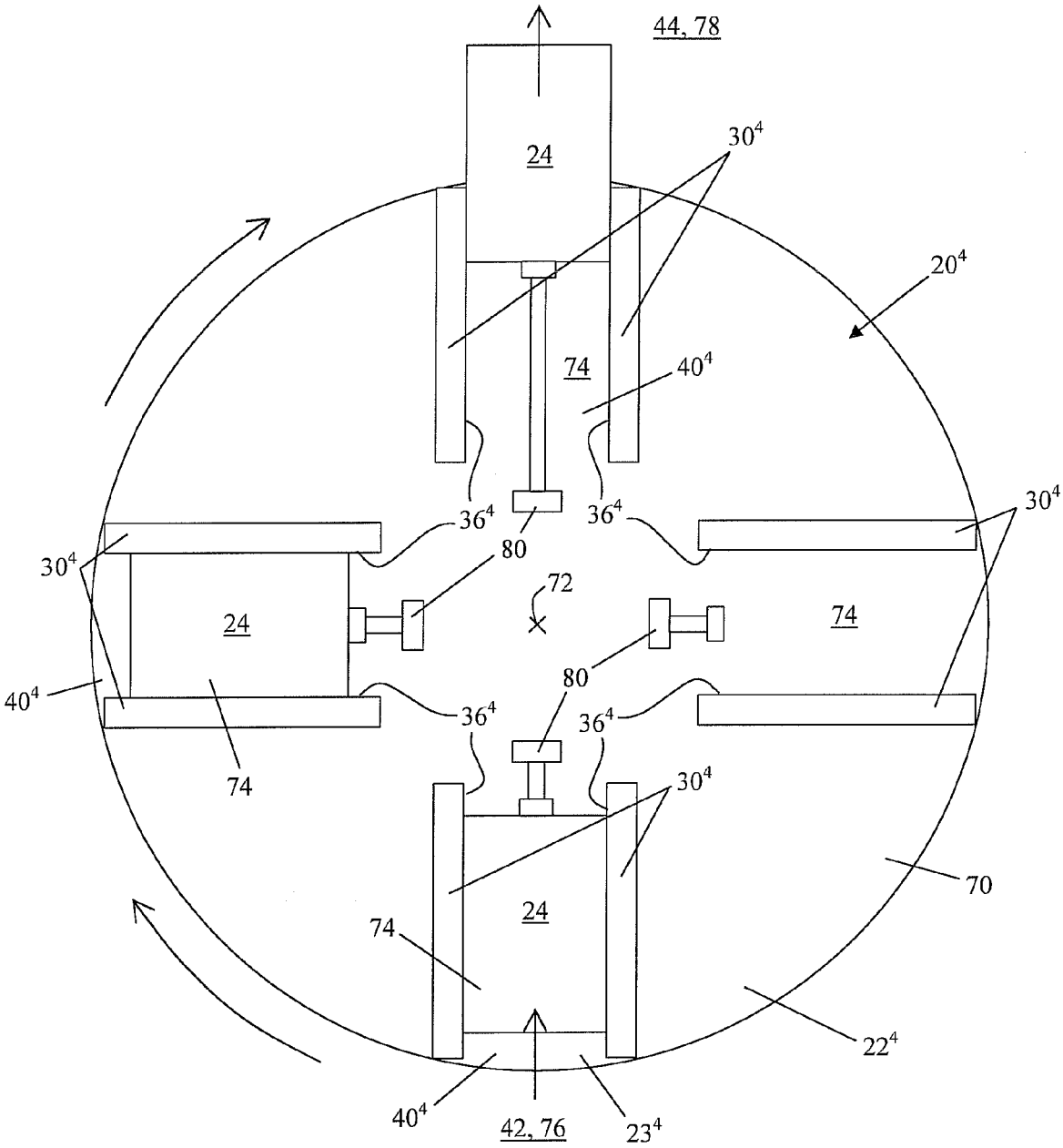
FIG. 14 is a schematic top view of workpieces arranged in circumferentially-spaced workpiece receptacle positions on a lower platen of a preheater constructed according to another alternative embodiment of the invention.

As shown in the embodiment of FIG. 14, the apparatus $\mathbf{20}^4$ may include an upper platen $\mathbf{22}^4$ and lower platen that comprise disc shaped turntables 70 supported for indexed rotation on a common vertical axis 72. According to this embodiment, the apparatus $\mathbf{20}^4$ may include circumferentially spaced workpiece receptacle positions 74 between the platens $\mathbf{26}^4$, each such receptacle position 74 being configured to receive a workpiece 24 at an input station 76, to heat the workpiece 24 to a desired temperature, and to carry the workpiece 24, via platen rotation, to an output station 78 where the workpiece 24 may be removed and transferred to a forming station 12. The preheater apparatus $\mathbf{20}^4$ may include an ejector 80 adjacent each workpiece receptacle position 74 configured to move a workpiece 24 radially outward when the workpiece 24 has been rotated to the output station 78. This presents the workpiece 24 within reach of a transfer mechanism such as a robot 6 to be engaged and moved to a forming station.

Figure 15:
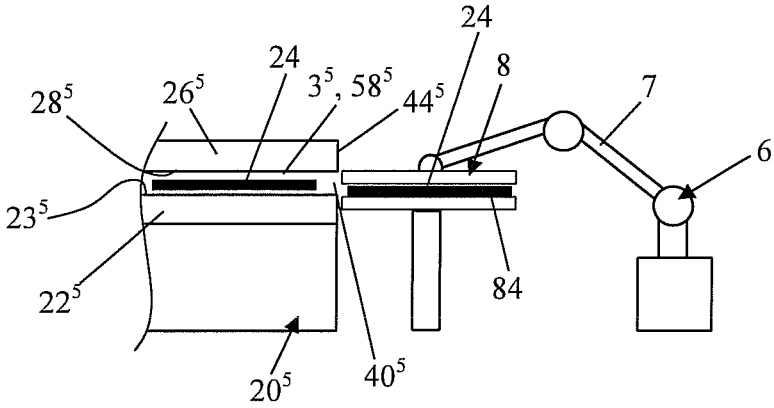
FIG. 15 is a schematic front view of a preheater constructed according to the invention and including a heated vacuum-driven end-effector and showing a robot carrying the end-effector and using the end-effector to engage a preheated workpiece.
Figure 16:
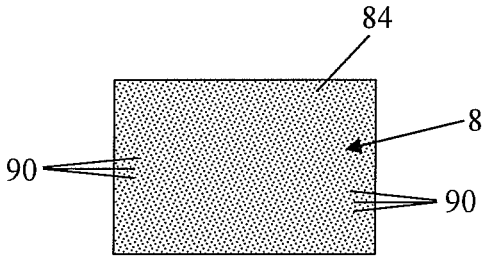
FIG. 16 is a schematic bottom view of the end-effector.
Figure 17:
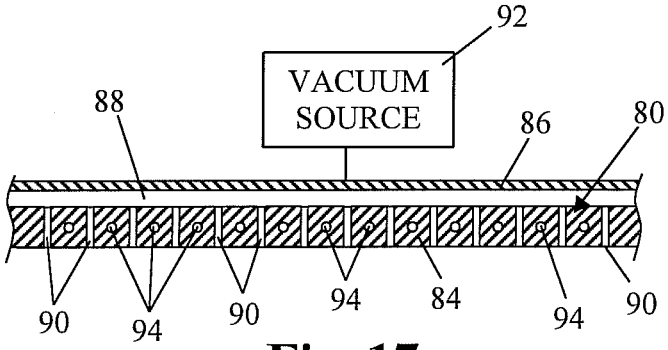
FIG. 17 is a schematic partial cross-sectional front view of the end-effector connected to a vacuum source.

As shown in the embodiment of FIGS. 15-17, the apparatus $\mathbf{20}^5$ may include an end effector 8 configured to be carried by a transfer mechanism such as a robot 6 and to engage and retain a sheet metal workpiece 24 for transport. The end effector 8 may be configured to transfer heat to the metal workpiece 24 to help maintain a desired workpiece 24 forming temperature during transport to a forming press $\mathbf{4}^5$. As shown in FIGS. 16 and 17, the end effector 8 may be configured to engage and retain metal workpieces 24 by suction to avoid damaging the workpieces 24 and to provide more uniform heat transfer to the workpieces 24 by contacting the workpieces 24 over a larger heated area. As shown in FIGS. 16 and 17, the end effector 8 may include perforated metal panel 84 which, as best shown in FIG. 17, may have a backside 86 defining a plenum 88 configured to provide fluid communication between perforations 90 of the panel 84 and a vacuum source 92. The end effector 8 may also include heating elements 94 embedded in the perforated metal panel 84 as is best shown in FIG. 17.

This elevated temperature forming process and preheater apparatus allow for the high volume fabrication of complex deep drawn panels such as door inners, lift gates, deck lids, and hoods from sheet metal workpieces comprising metals, such as aluminum, magnesium, having insufficient formability at lower temperatures.

This description, rather than describing limitations of an invention, only illustrates embodiments of the invention recited in the claims. The language of this description is therefore exclusively descriptive and is non-limiting. Obviously, it's possible to modify this invention from what the description teaches. Within the scope of the claims, one may practice the invention other than as described above.

What is claimed is:

1. A preheater apparatus for preparing sheet metal workpieces for forming, the apparatus comprising:

a lower platen having a generally planar upper surface and configured to transfer heat into a workpiece carried on the upper surface;

an upper platen disposed above the lower platen and having a generally planar lower surface disposed generally parallel to and spaced from the upper surface of the lower platen forming a gap between the platens, the upper platen being configured to transfer heat into a workpiece disposed between the upper platen and the lower platen, the upper and lower platens being disk-shaped and supported for co-rotation on a common axis;

a shim spacing the lower surface of the upper platen from the upper surface of the lower platen by a distance greater than a thickness of a sheet metal workpiece to be heated by the platens, the shim being arranged to at least partially define a blank path for serially receiving, passing, and removing workpieces from between the platens while maintaining a constant desired gap distance between the upper and lower platens; and a circumferentially-spaced workpiece receptacle positioned between the platens, each such receptacle position being configured to receive a workpiece at an input station, to heat the workpiece to a desired temperature, and to carry the workpiece via platen rotation to an output station.

2. A preheater apparatus as defined in claim 1 in which the preheater includes an ejector adjacent each workpiece receptacle position configured to move a workpiece radially outward when the workpiece has been rotated to the output station.

3. A preheater apparatus for preparing sheet metal workpieces for forming, the apparatus comprising:

a lower platen having a generally planar upper surface and configured to transfer heat into a workpiece carried on the upper surface;

an upper platen disposed above the lower platen and having a generally planar lower surface disposed generally parallel to and spaced from the upper surface of the lower platen forming a gap between the platens, the upper platen being configured to transfer heat into a workpiece disposed between the upper platen and the lower platen;

a shim spacing the lower surface of the upper platen from the upper surface of the lower platen by a distance greater than a thickness of a sheet metal workpiece to be heated by the platens, the shim being arranged to at least partially define a blank path for serially receiving, passing, and removing workpieces from between the platens while maintaining a constant desired gap distance between the upper and lower platens; and an end-effector configured to be carried by a transfer mechanism and to engage and retain a sheet metal workpiece for transport, the end-effector being configured to transfer heat to the metal workpiece.

4. A preheater apparatus as defined in claim 3 in which:

the preheater includes at least one additional shim;

each shim has a thickness equal to a desired gap distance between the upper and lower platens;

the shims include respective inner facing surfaces positioned generally parallel to one another between the upper and lower platens at a distance from one another slightly greater than a width of sheet metal workpieces to be passed between them, further defining the blank path.

5. A preheater apparatus as defined in claim 3 in which the preheater includes at least one spacer having a thickness less than the desired gap distance and configured to be disposable between successive sheet metal workpieces as the workpieces are being pushed along the blank path.

6. A preheater apparatus as defined in claim 3 in which the preheater includes at least one additional blank path extending generally parallel to the first blank path.

7. A preheater apparatus as defined in claim 3 in which the platens include at least two temperature zones arranged serially along the blank path and configured to raise workpieces to successively higher temperatures as the workpieces are moved along the blank path.

8. A preheater apparatus as defined in claim 3 in which the platens include a single temperature zone configured to raise workpieces to a desired temperature.

9. A preheater apparatus as defined in claim 3 in which the end-effector is configured to engage and retain the metal workpiece via suction.

10. A preheater apparatus as defined in claim 9 in which the end-effector includes a perforated metal panel having a back side configured to provide fluid communication between perforations of the panel and a vacuum source.

* * * * *